US010219632B2

(12) United States Patent
Mengshoel

(10) Patent No.: US 10,219,632 B2
(45) Date of Patent: Mar. 5, 2019

(54) ACTIVATING PLATFORM

(71) Applicant: Hans Christian Mengshoel, Gaupen (NO)

(72) Inventor: Hans Christian Mengshoel, Gaupen (NO)

( * ) Notice: Subject to any disclaimer, the term of this patent is extended or adjusted under 35 U.S.C. 154(b) by 0 days.

(21) Appl. No.: 15/305,525

(22) PCT Filed: May 23, 2014

(86) PCT No.: PCT/NO2014/050083
§ 371 (c)(1),
(2) Date: Oct. 20, 2016

(87) PCT Pub. No.: WO2015/178776
PCT Pub. Date: Nov. 26, 2015

(65) Prior Publication Data
US 2017/0042334 A1 Feb. 16, 2017

(51) Int. Cl.
*A47C 9/02* (2006.01)
*A47C 3/027* (2006.01)
*A47C 7/00* (2006.01)
*A47C 9/00* (2006.01)

(52) U.S. Cl.
CPC ..... *A47C 9/025* (2013.01); *A47C 3/027* (2013.01); *A47C 7/006* (2013.01); *A47C 9/002* (2013.01)

(58) Field of Classification Search
CPC ..... A47C 3/03; A47C 3/027; A47C 9/025; A47C 9/002; A47C 7/006
USPC ... 297/271.5, 4, 338, 344.18, 183.1, 188.08, 297/258.1, 175, 270.1, 370, 461
See application file for complete search history.

(56) References Cited

U.S. PATENT DOCUMENTS 1,065,022 A * 6/1913 Bell ..... A47C 9/005 248/413
3,312,437 A * 4/1967 Barth ..... A47C 3/029 248/158
4,552,404 A * 11/1985 Congleton ..... A47C 1/022 297/330
5,112,103 A * 5/1992 Downer ..... A47C 3/029 297/188.12
5,203,581 A * 4/1993 Jankowski ..... A47D 13/043 16/44
5,439,074 A * 8/1995 Trout ..... A01M 31/02 108/152
D467,745 S * 12/2002 Ryan ..... D6/364
7,077,469 B2 * 7/2006 Badia i Farre ..... A47C 3/20 297/195.11
7,597,397 B2 * 10/2009 McCoy ..... A47C 3/18 297/259.1
8,590,907 B2 * 11/2013 Hurt ..... A47C 9/027 280/47.131

(Continued)

*Primary Examiner* — Mark R Wendell
(74) *Attorney, Agent, or Firm* — Klarquist Sparkman, LLP

(57) ABSTRACT

An activating platform is disclosed. The platform includes a curved support plate. The support plate is divided into a standing area and a sitting area, the sitting area including a chair with a mounting arrangement and a seat. The curved shape of the support plate is meant to provoke the balance of a user standing or sitting on the platform, i.e. that the user has to use the muscles actively to hold the balance. Naturally, the user will rock around in a small angle around a middle position and flex in the hips and back to maintain the balance.

15 Claims, 3 Drawing Sheets

(56) References Cited

U.S. PATENT DOCUMENTS

| | | | | |
|---|---|---|---|---|
| 8,646,841 | B2 * | 2/2014 | Molnar | A47C 7/004 297/344.21 |
| 8,998,319 | B2 * | 4/2015 | Bahneman | A47C 9/00 297/195.11 |
| 9,750,348 | B2 * | 9/2017 | Sutherland | A47C 9/002 |
| 2003/0164633 | A1 * | 9/2003 | Jakus | A47C 9/002 297/271.5 |
| 2011/0109141 | A1 * | 5/2011 | Molnar | A47C 7/004 297/344.21 |
| 2011/0175414 | A1 * | 7/2011 | Asbjornsen | A47C 9/002 297/313 |
| 2012/0038122 | A1 * | 2/2012 | Canova | A47C 3/36 280/32.6 |
| 2013/0306831 | A1 * | 11/2013 | Keen | A47C 7/506 248/599 |

* cited by examiner

ACTIVATING PLATFORM

CLAIM OF PRIORITY/CROSS-REFERENCE TO RELATED APPLICATIONS:

This application is a U.S. national phase application under 35 U.S.C. § 371 of International Patent Cooperation Treaty (PCT) Patent Application No. PCT/NO2014/050083, filed on May. 23, 2014, the contents of which are incorporated herein in their entirety by reference.

FIELD OF THE INVENTION

The present invention relates to an activating platform.

BACKGROUND

An increasing number of people are experiencing problems with their back. One reason for this is assumed to be the way people are living spending a large part of the day sitting in conventional chairs, in cars or public transport means, in the office, and at home in the evening sitting in a recliner watching TV. This passive lifestyle leads to the muscles supporting the spinal column being under-stimulated and therefore reducing in size. Even in persons training regularly, these so-called core muscles are often under-stimulated. The core muscles are intended to support the body through a whole day of physical activity. Then, the core muscles will work automatically in stabilizing the back when the body is in motion. However, training a couple of evenings a week is not enough to support the core muscles. Due to modern lifestyle these muscles are often so weak that the automatic stabilizing action no longer works as it should. The result is pain due to sliding discs and strained muscles.

Another effect of under-stimulated core muscles is that the ability of keeping balance is impaired. This is particularly evident in elderly people who become dependent on roller chairs or other accessories, and often fall and become injured. The loss of balance is a problem for many elderly people. Even though this partially may be a consequence of age, there is an increasing belief that this effect mainly is caused by lifestyle, i.e. lack of physical exercise and time spent in improper chairs.

The present inventor has identified the common chair as one cause of these problems, and has since the 1970's tried to develop a better chair suited to modern lifestyle. The first result of this work was the so-called "Balans® chair". One version of this chair is described in Norwegian patent 145973. This chair includes a flat seat that is tilted forward and a leg support mounted in front of the seat. A person sitting on such a chair will straighten the back and obtain a position where the body is balanced along an axis through the body's centre of mass. This position is akin to a person on horseback, or the position often seen practiced by children sitting on the floor with the legs folded beneath them. This balance occurs naturally when standing, walking or running, and this chair allows a user to obtain such a balance also when sitting. However, this chair had a number of shortcomings, among others that the users complained of too large pressure on the knees. Thus, the inventor developed an improved version disclosed in Norwegian patent 320859. This chair includes a saddle seat and a leg support, the distance between the seat and the leg support being adjustable. The design of the saddle seat was later improved in Norwegian patent 328285.

There has been a trend in later years to provide working places with tables which are electrically adjustable in height.

Thus, the worker may lift the table top and work in a standing position. When this standing position gets wearing, the users may lower the table and continue working sitting on a chair. However, one reason for the standing position soon becoming wearisome is that the back is not properly supported by the core muscles, as mentioned above. Also, a flat, hard floor may be hard for the feet, as people are designed to move in an uneven terrain, not on a flat floor.

SUMMARY OF THE INVENTION

It is an object of the present invention to provide an activating platform that may help the user to train and maintain the muscles supporting the spinal column, and also to train the user's ability to balance the body with coordinated movements in the centre of his/her own gravity.

This is achieved in an activating platform as claimed in the appended patent claims. The activating platform includes a support plate which is curved underneath. The support plate is divided into an area for standing and an area for sitting, the sitting area including a chair mounted on the plate. The curved shape of the support plate is meant to provoke the balance of a user standing or sitting on the platform, i.e. that the user has to use the muscles actively to hold the balance. Naturally, the user will rock around in a small angle around a middle position and flex the hips and lower back to maintain the balance. These correcting back and forth movements of the muscles in order to regain and maintain the balance of the body will train the core muscles.

BRIEF DESCRIPTION OF THE DRAWINGS

The invention will now be described in detail in reference to the appended drawings, in which.

DETAILED DESCRIPTION

Figure 1:
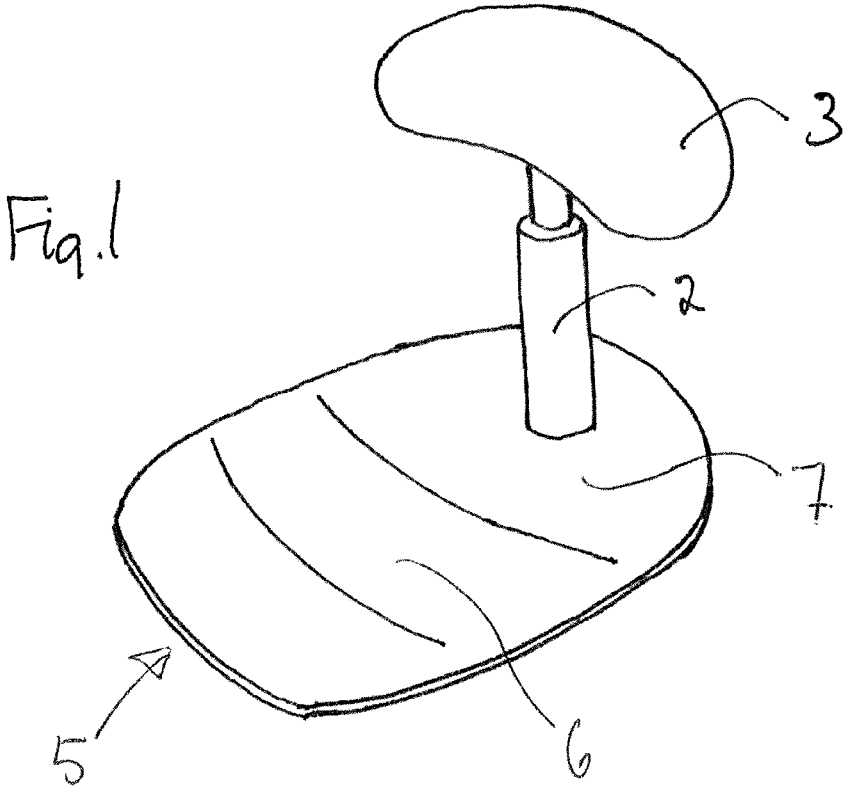
FIG. 1 is a perspective view of the invention.

The figures show an embodiment of the inventive activating platform comprising a slightly curved support plate 5 and a mounting arrangement 2 with gas lift cylinder and a saddle seat 3 mounted on the plate. The support plate is designed to be so roomy that the user may rise and stand on the platform in front of the seat. Thus, the platform forms a combined standing and sitting platform divided into an area or part 6 for standing on and an area 7 for sitting, i.e. the part of the platform with the chair. The platform may find application as a work platform for a person performing a part of or perhaps the main part of his work standing, but who occasionally wants to sit down. The plate is designed with a curvature allowing a person to stay thereon during a whole day of work without feeling exhausted. This is apart from dedicated training platforms intended to be used only for short periods.

The seat may be of any shape suited for the purpose, but is preferably of the saddle shaped variety, e.g. the seat disclosed in Norwegian patent 328285, which is owned by the present inventor. However, the embodiment of the invention shown in FIG. 1 employs a different saddle shaped seat that is not so long as the seat in NO 328285, but of the same or a similar width. The shallow shape of the seat allows more room for the user on the support platform.

In FIG. 1 the seat 3 is mounted with its sitting direction 90° on the rocking direction of the support plate 5.

Figure 2A:
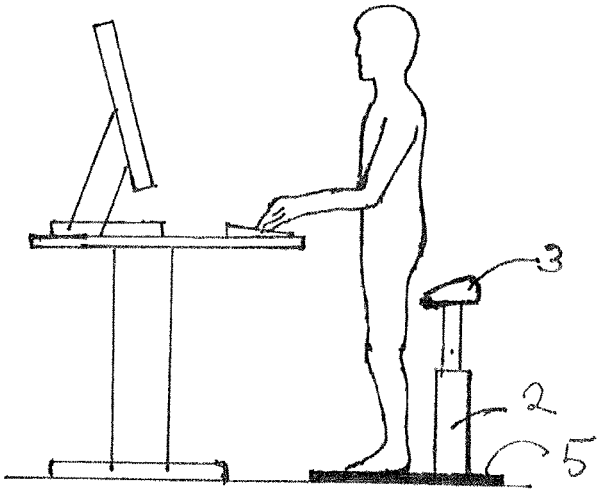
FIG. 2*a, b* shows a user standing on the inventive activating platform.

FIG. 2*a* shows a user standing on the activating platform while working at an adjustable computer table. The user is standing in front of the chair.

Figure 2B:
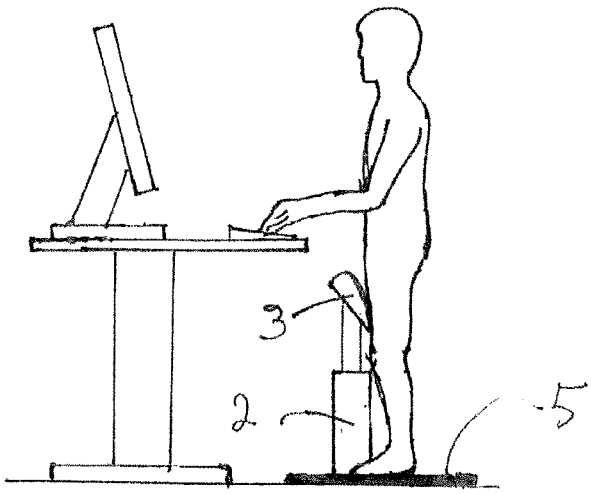

In FIG. 2*b* the user is standing on the platform in front of the chair. The seat 3 has been tilted forward, now acting as a leg support.

Figure 3:
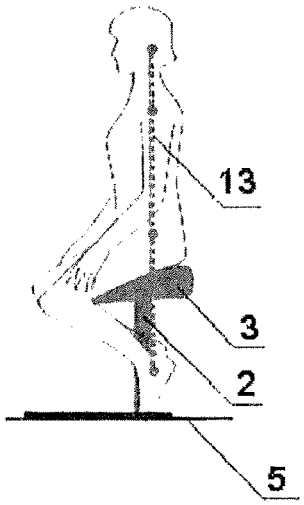
FIG. 3 is a side view of the inventive balance platform, with a person seated on the chair.
Figure 4:
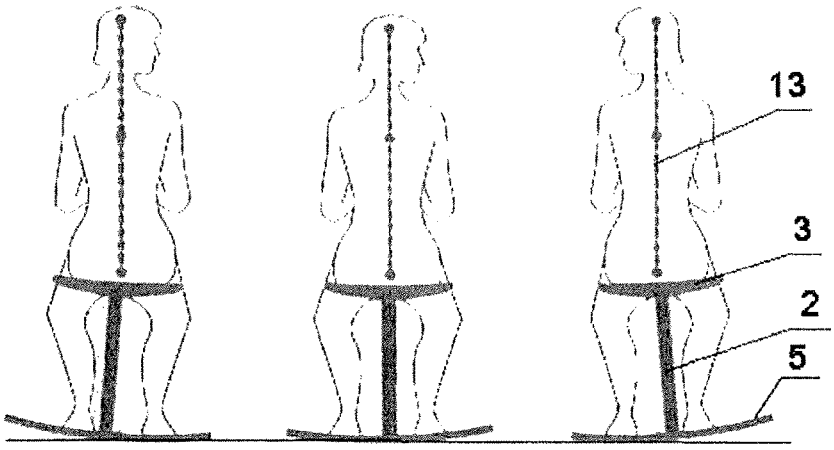
FIG. 4 is a front view of the balance platform, in three different positions.

In FIGS. 3 and 4 a user is sitting on the chair, more or less like riding on horseback. The chair allows the user to find a comfortable sitting position wherein the body is in balance along a line or axis through the middle of the body from the head to the feet. The balance line is indicated in the figures with a line 13. This balanced sitting position is beneficial as the body will have to use its muscles to maintain the balance, thus obtaining a measure of training said muscles. The object of the support plate 5 is to provoke this balance. The body is thrown out of balance, and has to regain the balance by flexing the hips and lumbar area. The body will start rocking, and thereby train the muscles in the back and belly supporting the spinal column. This is illustrated in FIG. 3, showing a user sitting on the chair. In the middle position the user is in balance, as shown by the line 13 and the thick bar in the background, both being in line. In the leftmost position, the user has rocked the chair towards the left and tries to regain balance by flexing in the lower back. This is shown by the line 13 still being vertical. In the rightmost position, the user has rocked towards the right, again compensating for the unbalance.

In order to obtain the desired provocative effect, the support plate 5 should form a cylindrical arched contact plane towards the floor. The curvature should equal a radius corresponding to the hip height of the user. The hip height is of course dependent on the height of the user, but in adults a hip height of 800 to 1200 mm may be assumed. Thus, a radius of about 1000 mm is preferred, as this will suit an average user. When standing, the user will approach a position akin to Leonardo's famous figure, the feet meeting the plate at a normal angle, and with the calves and knee joints normal to the plate. However, the hip height should be a projected hip height, as discovered by Michelangelo, still referring to classical art theory. The possible extent of rocking could also be limited to about +−50 mm (in horizontal direction, measured at the hips), to avoid the body leaving the range where it can handle the rocking movement. To limit the rocking range, the curvature could be reserved to the central area of the plate, with flattened parts outside this area.

Alternatively, stoppers could be mounted on the underside of the plate, on both ends thereof.

The plate may be produced in laminated wood, plastic or metal. The plastic material may be fibre reinforced. One function of the support plate is to prevent the user from placing the feet on the ground/floor. With the feet on the ground, the body will no longer find balance in the desired optimal way. For this reason, conventional open runners are avoided.

The plate may be designed as a curved plate or as a flat plate with runners.

Figure 5:
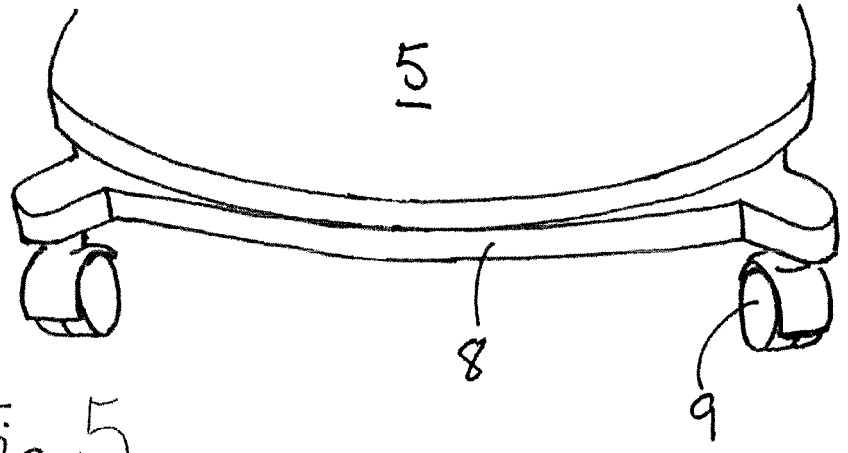
FIG. 5 shows an implementation of the inventive balance platform mounted on a wheeled dolly.

FIG. 5 shows how the chair may be supported on a wheeled platform or dolly 6. The dolly includes a frame or plate 8 with castors 9. The support plate 5 is fastened to the dolly by a system of springs (not shown) located below the plate. The spring system may be similar to the system used in the old fashioned "American" rocking chair, or a more modern system of torsion spring.

A point of the invention is that the user in all positions, even when seated, should have the feet placed on the support plate, and not as in conventional rocking chairs, where the user may place the feet on the floor. It is important to understand the difference between this chair and the common rocking chair. In a rocking chair the body is not in balance, but is resting against a backrest. The system of chair and body may be in balance, but the body is resting unbalanced and is moved by the chair. The runners of a rocking chair are shaped to allow the user to find a stable lean back position. Thus, the body is passivated and there is no activation of the muscles. In principle, there are two ways of sitting, either balanced in the centre of one's own gravity, or in an unbalanced position. The inventive chair is designed to move in a small range around the middle position. Thus, the support plate is symmetrically shaped.

The invention claimed is:

1. An activating platform, comprising:

a base including an elongated support plate that extends along a longitudinal axis, the elongated support plate having a first end, a second end, a standing portion adjacent the first end, and a sitting portion adjacent the second end; and a chair comprising a support arrangement with a seat mounted thereon, the support arrangement extending upward from the sitting portion of the elongated support plate, wherein the base has a lower surface that contacts a ground surface beneath the activating platform when the activating platform is in use, the lower surface of the base being curved in a direction transverse to the longitudinal axis to permit the activating platform to move from side to side.

2. The activating platform as recited in claim 1, wherein the lower surface of the base is a bottom surface of the elongated support plate.

3. The activating platform as recited in claim 2, wherein the bottom surface of the elongated support plate has a cylindrical curvature.

4. The activating platform as recited in claim 1, wherein the lower surface of the base comprises at least one curved runner disposed below the elongated support plate.

5. The activating platform as recited in claim 1, wherein the lower surface of the elongated support plate is curved with a radius between 800 millimeters (mm) and 1200 millimeters (mm).

6. The activating platform as recited in claim 5, wherein the lower surface of the elongated support plate is curved with a radius of about 1000 mm.

7. The activating platform as recited in claim 1, wherein the seat comprises a saddle-shaped configuration.

8. An activating platform, comprising:

a base comprising a rear portion that defines a sitting area and a front portion extending forward from the rear portion that defines a standing area, the front portion being adjacent a first end of the base and the rear portion being adjacent a second end of the base, the first end being located opposite the second end, wherein the base has an underside with at least one curved surface that contacts a ground surface beneath the activating platform when in use, the at least one curved surface being curved along at least a portion of a width of the base, enabling the base to move laterally from side to side along the at least one curved surface in a defined rocking movement.

9. The activating platform as recited in claim 8 wherein the base is elongated along a longitudinal axis.

10. The activating platform as recited in claim 8 wherein the sitting area comprises a seat coupled to a support arrangement, the support arrangement extending upward and coupled to the rear portion of the base.

11. The activating platform as recited in claim 8, wherein the at least one curved surface comprises a cylindrical curvature.

12. The activating platform as recited in claim 8, wherein the at least one curved surface of the base comprises at least one curved runner.

13. The activating platform as recited in claim 8, wherein the at least one curved surface is curved with a radius between 800 millimeters (mm) and 1200 millimeters (mm).

14. The activating platform as recited in claim 13, wherein the at least one curved surface is curved with a radius of about 1000 mm.

15. The activating platform as recited in claim 8, wherein the seat comprises a saddle-shaped configuration.

* * * * *